US005881659A

United States Patent [19]

Sato

[11] Patent Number: 5,881,659

[45] Date of Patent: Mar. 16, 1999

[54] BOBBIN THREAD CUTTING DEVICE OF A SEWING MACHINE

[75] Inventor: Mikio Sato, Ama-gun, Japan

[73] Assignee: Brother Kogyo Kabushiki Kaisha, Nagoya, Japan

[21] Appl. No.: 909,847

[22] Filed: Aug. 12, 1997

[30] Foreign Application Priority Data

Aug. 21, 1996 [JP] Japan ..... 8-219721

[51] Int. Cl.[6] ..... D05B 65/00

[52] U.S. Cl. ..... 112/298

[58] Field of Search ..... 112/129, 188, 112/231, 254, 298, 296, 299, 260, 285, 197

[56] References Cited

U.S. PATENT DOCUMENTS

| | | | |
|---|---|---|---|
| 3,191,560 | 6/1965 | Marforio | 112/297 |
| 3,461,826 | 8/1969 | Scholl et al. | 112/297 |
| 4,421,043 | 12/1983 | Kornatowski et al. | 112/260 |
| 4,702,185 | 10/1987 | Hanyu et al. | 112/254 |
| 5,025,737 | 6/1991 | Kamiya | 112/296 |
| 5,131,340 | 7/1992 | Tajima et al. | 112/292 |

FOREIGN PATENT DOCUMENTS

| | | |
|---|---|---|
| B2-56-20876 | 5/1981 | Japan . |
| Y2-61-8852 | 3/1986 | Japan . |
| A-4-96790 | 3/1992 | Japan . |
| A-4-96791 | 3/1992 | Japan . |
| A-4-99585 | 3/1992 | Japan . |

*Primary Examiner*—Michael A. Neas
*Assistant Examiner*—Tejash D Patel
*Attorney, Agent, or Firm*—Oliff & Berridge, PLC

[57] ABSTRACT

A bobbin thread cutting device of a sewing machine for cutting a bobbin thread and for temporarily anchoring an end of the cut thread. The bobbin thread cutting device has a cover openably attached to a bed. The cover is formed with a guide groove in which a cutting blade is positioned. A blade edge of the cutting blade and a side edge of the guide groove define an acute-angled portion. A direction in which the bobbin thread is pulled out of the bed through the guide groove intersects a direction in which the bobbin thread extends from a tension generating portion of the bobbin case when the bobbin thread is about to be cut. A leading end of a cut bobbin thread is temporarily anchored at the acute-angled portion.

31 Claims, 10 Drawing Sheets

BOBBIN THREAD CUTTING DEVICE OF A SEWING MACHINE

BACKGROUND OF THE INVENTION

1. Field of the Invention

The present invention relates to a bobbin thread cutting device of a sewing machine for cutting a bobbin thread extending out of a bobbin case provided within a bed of the sewing machine, and more specifically, to a bobbin thread cutting device capable of cutting a bobbin thread so that an extending portion of the bobbin thread will be of a predetermined length necessary for forming a first stitch in sewing operations, and temporarily anchoring an end portion of the cut thread as a result of cutting.

2. Description of the Prior Art

Conventionally, a preparatory operation is needed before performing sewing operations. That is, after inserting a bobbin case with a bobbin holding a bobbin thread into a loop taker, a needle with a needle thread stitches once without cloth on a bed. Then, when an end of the needle thread is pulled, the bobbin thread is drawn out of a needle hole of the needle plate. Also, at this time, a needle thread and the bobbin thread are excessively drawn out.

Japanese Patent Publication No. SHO-56-20876 describes a sewing machine with which no preparatory operation to draw out the bobbin thread is needed. As shown in FIG. 1, the sewing machine includes a needle 113 maintained vertically and movably up and down, a bed 111, a loop taker 118 positioned within the bed, a bobbin case 119 removably mounted inside the loop taker 118, a bobbin 120 holding a bobbin thread 102 and removably mounted in the loop taker 118, and a bed slide 121 provided on an upper surface of the bed 111 near the loop taker 118. The loop taker 118 forms lock stitches in cooperation with the needle using the bobbin thread 102 and a needle thread (not shown). A user can slide open the bed slide 121 to access the bobbin 120 and/or bobbin case 119 for replenishing or replacing the bobbin thread 102.

A cutting blade 122 for cutting the bobbin thread 102 is installed on a free end of the bed slide 121. Also, a bobbin thread cutting assist member 124 is provided in the bed 111 so as to be positioned near a blade edge 122*a* of the cutting blade 122 when the bed slide 121 is in a closed position. A midway portion of the bobbin thread 102 pulled out of the bobbin case 119 is bent into an approximate Z-shape around the cutting blade 122 and the bobbin thread cutting assist member 124.

With this configuration, when the bed slide 121 is closed after the bobbin case 119 with the bobbin 120 has been inserted to the loop taker 118, the bobbin thread 102 issuing from the bobbin case 119 is easily cut to a certain length necessary for forming a first stitch. It is unnecessary to draw out the bobbin thread 102 in preparatory operations using a needle thread, and the sewing operations can be begun immediately after inserting the bobbin case 119. Also, a length of a needle thread extending from the needle can be shortened, and a neat stitch can be formed.

However, a direction in which the bobbin thread 102 extends out of the bed 111 is approximately in parallel with a direction in which the thread 102 extends from the bobbin case 119 to the bobbin cutting assist member 124. Therefore, if there is little overlap in the parallel portions of is thread 102, the frictional resistance in the bent portions of the Z-shape is insufficient to cut the bobbin thread 102. Also, if the user pulls out the bobbin thread at this time, the thread 102 has a tendency to slip over the blade edge 122*a* and be pulled out too far before being cut. In addition, the end of cut bobbin thread 102 may fall inside the bed 111 of the sewing machine, and may be suspended from the loop taker 118.

On the other hand, if the cutting blade 122 and the bobbin thread cutting assist member 124 are positioned to provide a larger overlap in the parallel portions of the bobbin thread 102 to provide more acute bending angle in the Z-shaped portion of the thread 102, a risk of collision between a surface of the cutting blade 122 and an edge of the bobbin thread cutting assist member 124 when closing the bed slide 121 increases, thereby inviting damage to the cutting blade 122 and reducing durability thereof.

SUMMARY OF THE INVENTION

In view of the foregoing, it is an object of the present invention to overcome the above-described problems and to provide a bobbin thread cutting device for a sewing machine which eliminates the preparatory process of drawing out a bobbin thread, allowing the sewing operations to begin immediately after a bobbin case has been inserted.

Also, it is another object of the present invention to provide a bobbin thread cutting device capable of reliably cutting a bobbin thread to a predetermined length and reliably anchoring the end of the bobbin thread temporarily after the thread is cut.

These and other objects of the present invention will be attained by providing a sewing machine including a bed having an internal portion, a needle plate formed with a needle hole on the bed, a needle retaining a needle thread and movable into and out of the needle hole, a loop taker positioned within the bed, a bobbin case, a bobbin, a cover, and a cutting blade. The bobbin case is removably mounted inside the loop taker. The bobbin case has a tension generation portion. The bobbin holds a bobbin thread and is removably mounted in the bobbin case. The bobbin thread extends out of the bobbin case through the tension generation portion. The loop taker forms stitches in cooperation with the sewing needle using the bobbin thread and the needle thread. The bobbin thread has a leading end portion and a subsequent portion. The cover is attached to the bed near the loop taker and is movable between an open position and a closed position. The cover extends in a vertical direction at the closed position. The cutting blade is adapted for cutting the bobbin thread extending out of the bobbin case. The cutting blade is provided at one of the cover and the bed near the cover. The leading end portion of the bobbin thread is pulled out of the bed and extends from the cutting blade in a first direction and the subsequent portion of the bobbin thread is pulled from the tension generating portion in a second direction when the bobbin thread is about to be cut. The cutting blade provides a geometrical relationship with respect to the tension generating portion to intersect the first direction with the second direction.

In another aspect of the present invention, there is provided a sewing machine including a bed having an internal portion, a needle plate formed with a needle hole on the bed, a needle retaining a needle thread and movable into and out of the needle hole, a loop taker positioned within the bed, a bobbin case, a bobbin, a cover, a cutting blade, and a support. The bobbin case is removably mounted inside the loop taker. The bobbin case has a tension generation portion. The bobbin holds a bobbin thread and is removably mounted in the bobbin case. The bobbin thread extends out of the bobbin case through the tension generation portion. The loop taker forms stitches in cooperation with the sewing needle using the bobbin thread and the needle thread. The cover is attached to the bed near the loop taker, and is movable between an open position and a closed position. The cover extends in a vertical direction at the closed position. The cutting blade has a blade edge for cutting the bobbin thread extending out of the bobbin case. The cutting blade is provided at one of the cover and the bed near the cover. A bobbin thread passage is defined between the tension generating portion and the blade edge. The support member is provided to one of the cover and the bed for supporting the bobbin thread between the tension generation portion and the blade edge. The support member is positioned between the tension generating portion and the blade edge, and has the bobbin thread passage to be bent.

In still another aspect of the present invention, there is provided a bobbin thread cutting device having the above described cutting blade or the above described combination of the cutting blade and the support member to be incorporated into a sewing machine

DETAILED DESCRIPTION OF THE PREFERRED EMBODIMENT

A bobbin thread cutting device according to preferred embodiments of the present invention will be described while referring to the accompanying drawings. In the following description, the expressions "front", "right", "left", "upper", "lower" and "vertical" are used throughout the description to define the various parts when the sewing machine is disposed in an orientation in which it is intended to be used.

Figure 1:
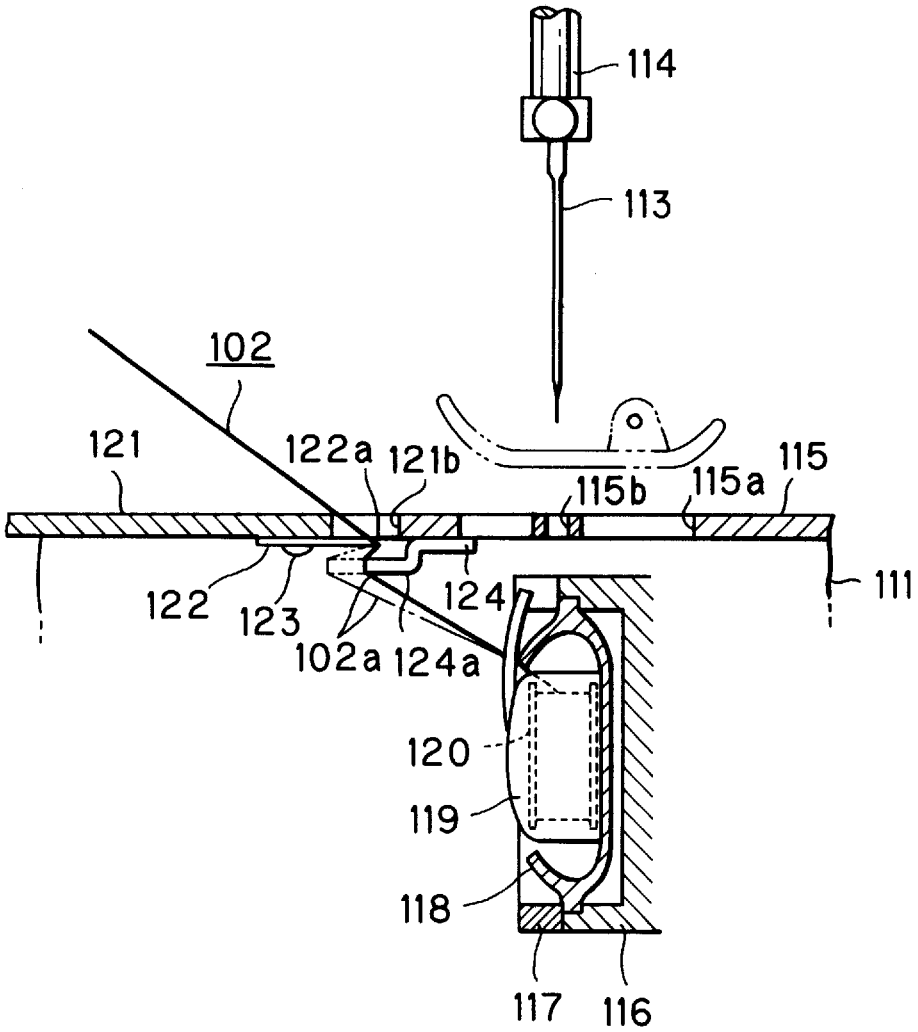
FIG. 1 PRIOR ART
FIG. 1 is a cross-sectional view showing a sewing machine having a conventional bobbin thread cutting device.
Figure 2:
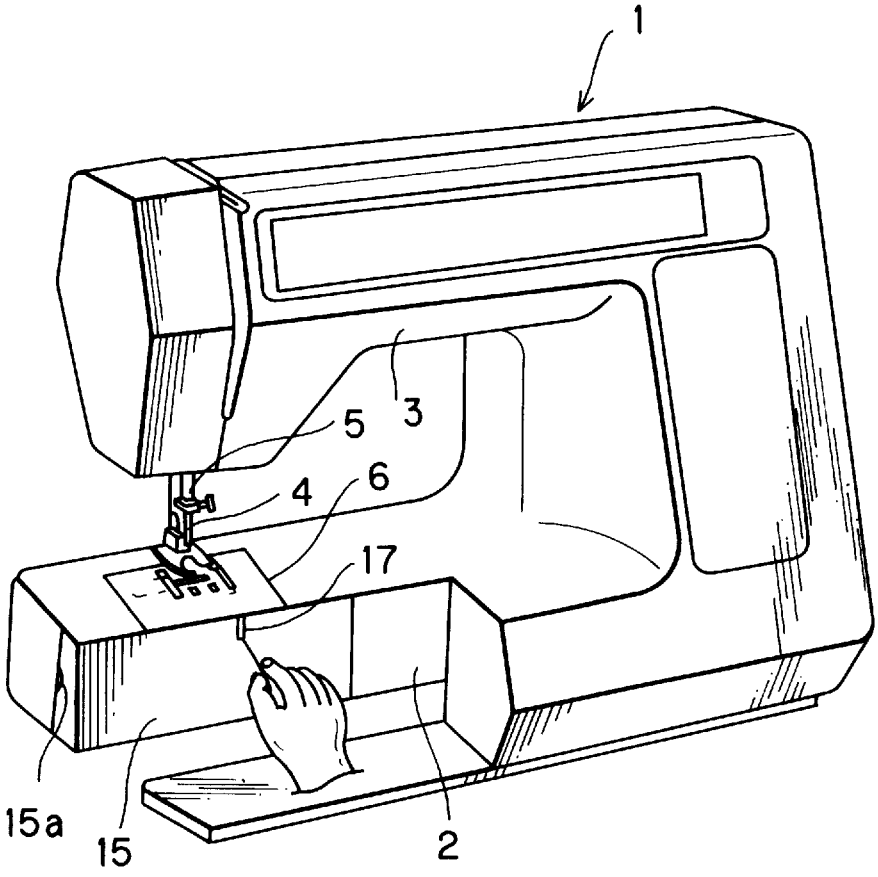
FIG. 2 is a perspective view showing a sewing machine having a bobbin thread cutting device according to a first embodiment of the present invention.
Figure 3:
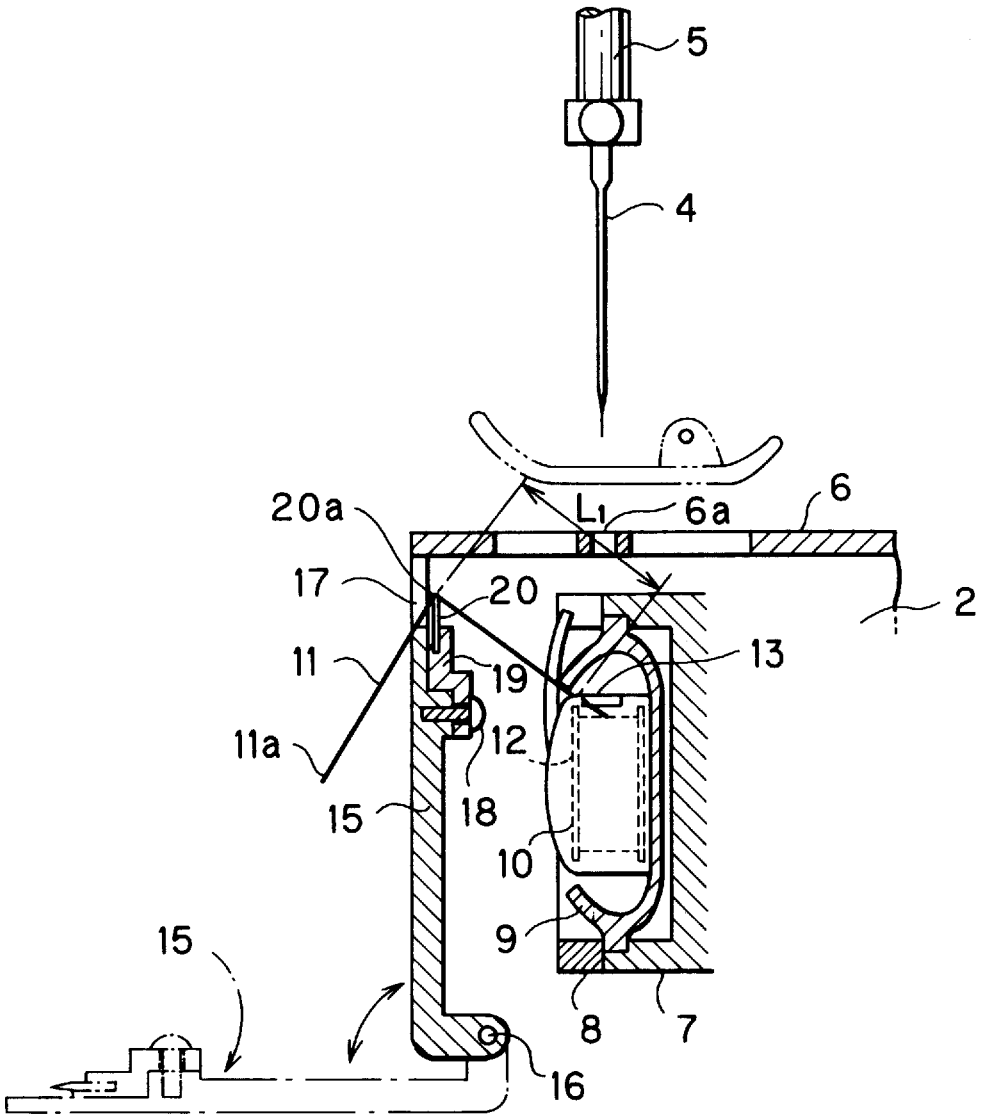
FIG. 3 is a cross-sectional view showing the relevant components of FIG. 1 but in accordance with the first embodiment.
Figure 13:
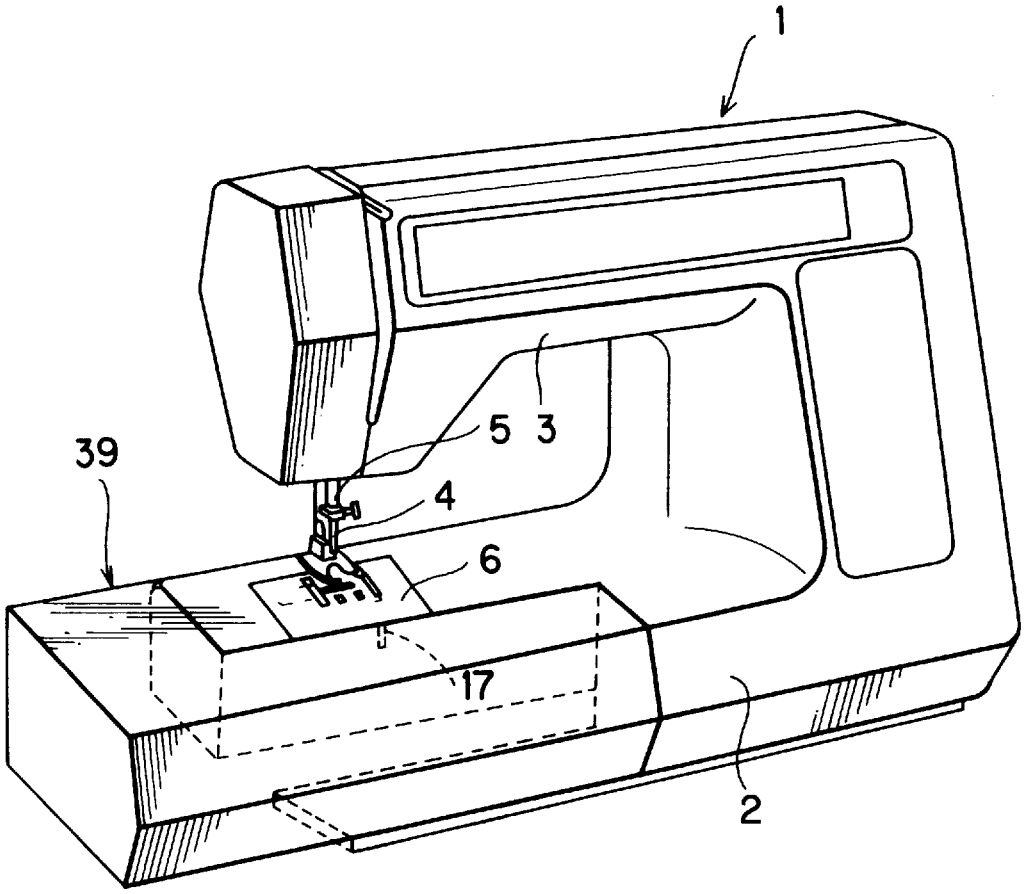
FIG. 13 is a perspective view showing an auxiliary bed member mounted on a free arm bed of a sewing machine according to a modification to the first or second embodiment.

First, a bobbin thread cutting device according to a first embodiment will be described with reference to FIGS. 2 through 6. As shown in FIG. 2 and 3, a sewing machine 1 includes a free arm bed portion 2 and a sewing arm 3. The free arm bed portion 2 makes up a bed with a detachable bed portion 39 as shown in FIG. 13. The sewing machine 1 further includes a needle bar 5 vertically movably provided on a lower left surface of the sewing arm 3, a needle 4 attached to the needle bar 5, a needle plate 6 provided on an upper surface of the free arm bed portion 2, and a cover 15 positioned on a front side surface of the free arm bed portion 2 adjacent to the needle plate 6. The needle plate 6 is formed with a needle hole 6*a*, through which the needle 4 passes.

Within the free arm bed portion 2, there are provided a shuttle race 7 underneath the needle plate 6, a shuttle hook 9 mounted in the shuttle race 7 and supported in a shuttle hook block 8, a bobbin case 10 removably mounted in the shuttle hook 9, and a bobbin 12 removably mounted in the bobbin case 10 and holding a bobbin thread 11. The shuttle hook 9 serves as the loop taker and forms lock stitches in cooperation with the needle 4 using the bobbin thread 11 and a needle thread (not shown).

The bobbin case 10 includes a tension generating portion 13 for applying tension on the bobbin thread 11. For example, if the bobbin thread 11 is No. 50 cotton thread having a diameter of 0.15 millimeters, the tension generating portion 13 applies a tension of 30 grams to the bobbin thread 11. If the bobbin thread 11 is No. 50 silk thread having a diameter of 0.10 millimeters, the tension generating portion 13 applies a tension of 26 grams.

The cover 15 is composed of a synthetic resin or the like. The cover 15 is openably attached to the free arm bed portion 2 via a hinge 16, opening forward from the top. The cover 15 is formed with a fingerhold 15*a* in the left end side, and a guide groove 17 with an opening on a free end. The guide groove 17 has an approximate U shape as viewed from the front (FIG. 5).

When the cover 15 is in a closed position, the bobbin 12 in the bobbin case 10 opposes an inner surface of the cover 15, and the cover is orthogonal to the rotational axis of the bobbin 12. The angular movement direction of the cover 15 intersects with the rotational axis of the bobbin 12.

Figure 5:
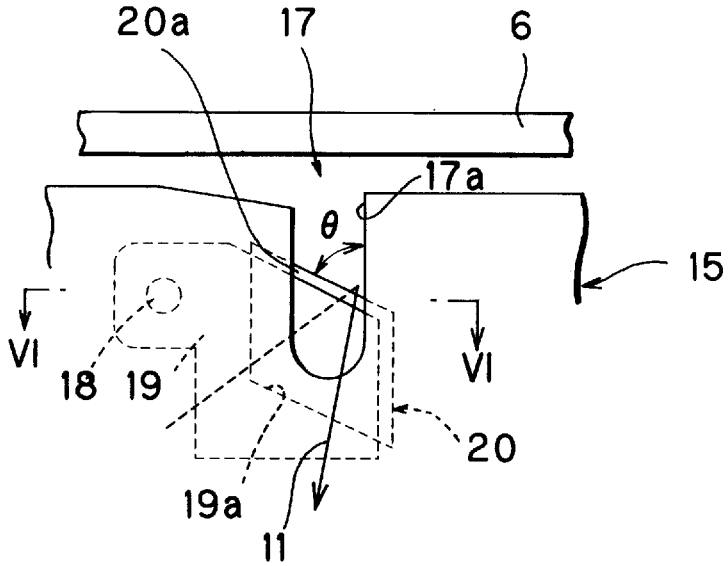
FIG. 5 is a front view showing an arrangement of a guide groove and a cutting blade according to the first embodiment.
Figure 6:
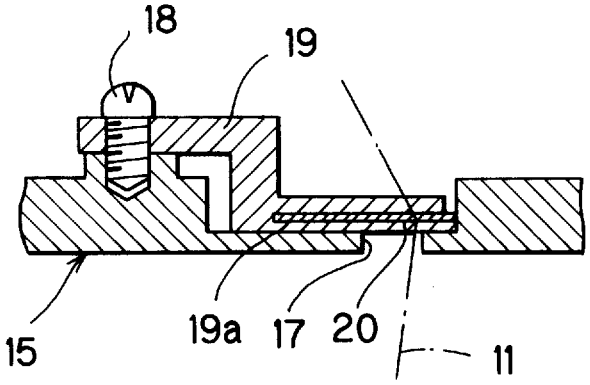
FIG. 6 is a cross-sectional view taken along the line VI—VI of FIG. 5.

As shown in FIGS. 5 and 6, a support 19 composed of a synthetic resin or the like is attached on an inner surface of the cover 15 via a screw 18. The support 19 is formed with a mounting groove 19*a*, in which a cutting blade 20 with blade edge 20*a* is detachably mounted. The cutting blade 20 is arranged on a lower end of the guide groove 17 with the blade edge 20*a* facing upward. At this time, a line extending along the blade edge 20*a* intersects with a line extending along a right side edge 17*a* of the guide groove 17 so as to form an acute angle θ as shown in FIG. 5.

Next, operation of the bobbin thread cutting device will be described. First, the cover 15 is opened to the position shown by a dotted chain line in FIG. 3. Next, the bobbin case 10 with the bobbin 12 inside is inserted to the shuttle hook 9. At this time, the leading end portion of the bobbin thread is extending out of the bobbin case 10 through the tension generating portion 13. Then, the bobbin thread 11 extending out of the bobbin case 10 is guided out through the wide opened gap between the needle plate 6 and the cover 15. After the cover 15 is closed, the midway portion of the bobbin thread 11 is guided into the guide groove 17. The bobbin thread 11 is brought in contact with the blade edge 20*a* of the cutting blade 20. Then, by being pulled in a downward slanting direction as shown in FIGS. 3 and 5, the bobbin thread 11 is reliably cut with little tensile force. An end of the cut bobbin thread 11 is temporarily anchored at intersecting portion of the blade edge 20*a* and the right side edge 17*a*.

Because the portion of bobbin thread 11 extending from the tension generating portion 13 to the blade edge 20*a* is not parallel with the portion of bobbin thread 11 being pulled out of the cover 15, the bobbin thread 11 can be cut by applying less tensile force than tensile force applied on the bobbin thread 11 by the tensile force generating portion 13. Also, because the bobbin thread 11 bends over the blade edge 20*a* at an acute angle, a resisting force is created, allowing the bobbin thread 11 to be cut reliably with little tensile force.

Figure 4:
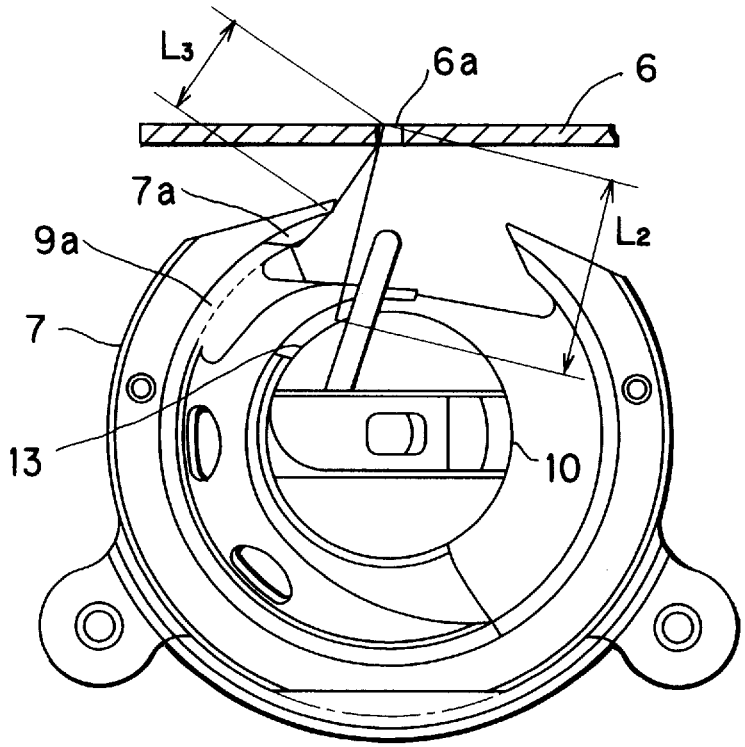
FIG. 4 is a plan view showing a shuttle hook.

FIG. 3 shows a length L1 between the tension generating portion 13 and the blade edge 20*a*. Also, FIG. 4 shows a length L2 between the tension generating portion 13 to the needle hole 6*a* at which a stitch is formed, and a length L3 between the race surface of the shuttle race 7 and the needle hole 6*a*. The race surface 7*a* represents the end portion of the shuttle race 7 that a loop seizing beak 9*a* of the shuttle hook 9 passes to take a thread loop. The race surface supports the loop taker in a stitch forming operation. In this embodiment, the length L1 is set longer than the length L2. The length L1 is set shorter than the sum of the length L2 and the length L3. That is, $L2<L1<L2+L3$. For example, it will be assumed that $L2=20\text{ mm}<L1=28\text{ mm}<31\text{ mm}=(L2+L3)$.

With this configuration, when the end portion of the bobbin thread 11 is cut off by the blade edge 20*a* of the cutting blade 20, a length of the bobbin thread 11 extending out of the bobbin case 10 through the tension generating portion 13 will be the predetermined length L1. Because the length L1 of the bobbin thread 11 is longer than the length L2, the bobbin thread 11 trapped by the needle thread reaches sufficiently the needle hole 6*a* for forming a first needle stitch. Therefore, a stitch can be reliably formed. Further, because the length L1 is set shorter than the sum of the lengths L2 and L3, an extra portion of bobbin thread 11 after forming the first stitch will not be so long as to be entangled between the surface of the shuttle race 7 and the shuttle hook 9.

As shown in FIG. 5, the guide groove 17 has a vertically elongated U shape and the blade edge 20*a* of the cutting blade 20 is positioned near the bottom side of the guide groove 17. Therefore, it is unlikely that the bobbin case 10 and the blade edge 20*a* will collide during installation or detachment of the bobbin case 10 to and from the shuttle hook 9. Thus, degradation of the blade edge 20*a* can be avoided, leading to increased durability of the cutting blade 20. Because the support 19, in which the cutting blade 20 is mounted, is fixed to the cover 15 via the screw 18, it is extremely easy to replace the small cutting blade 20.

Figure 7:
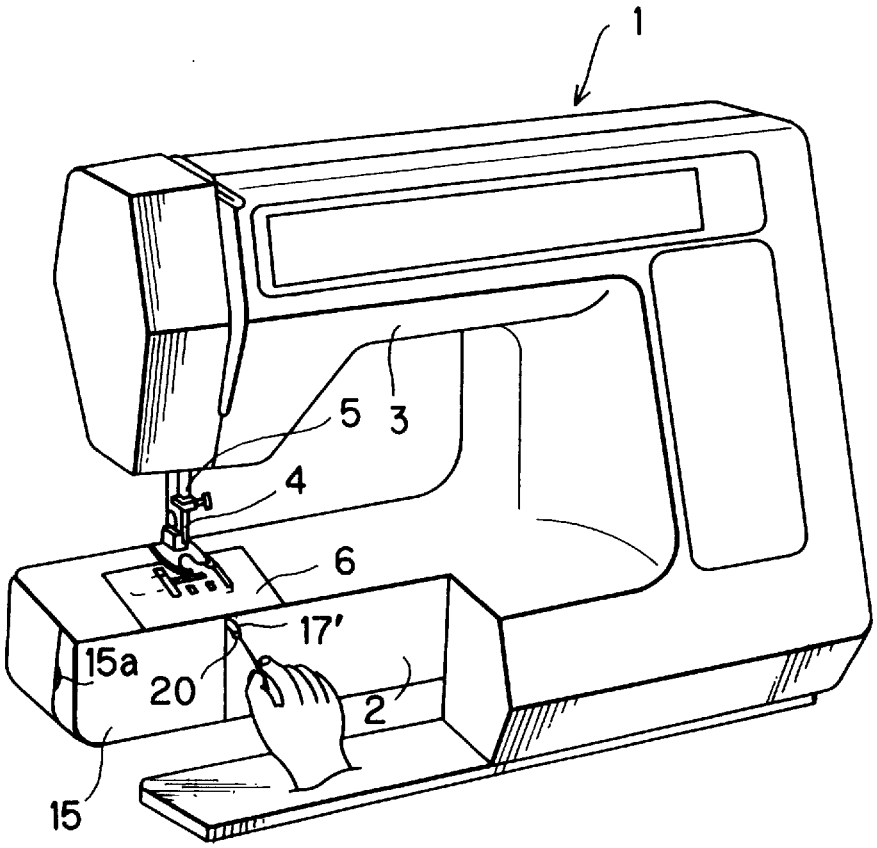
FIG. 7 is a perspective view showing a sewing machine having the bobbin thread cutting device according to a modification to the first embodiment.

FIG. 7 shows a modification to the first embodiment of the present invention. According to the first embodiment, the guide groove 17 is formed in the cover 15. On the other hand, in the modification, a guide groove 17' with an opening is formed on the free arm bed portion 2. The free arm bed portion 2 has a side edge facing with a free end portion of the cover 15 when the cover 15 is closed. In the modified embodiment, the guide groove 17' is formed at the side edge of the free arm bed portion 2 in such a manner that an opening of the guide groove 17' is at an edge line, and is positioned in the vicinity of the free end portion of the cover 15. In this case, the cutting blade 20 mounted in the support 19 is removably attached on the back surface of the free arm bed portion, and at the lower portion of the guide groove 17'.

Next, a bobbin thread cutting device according to a second embodiment of the present invention will be described with reference to FIGS. 8 through 11. A cover 30 composed of a synthetic resin or the like is openably attached to the free arm bed portion 2, opening forward from the top, via the hinge 16. The cover 30 is positioned on a front side surface of the free arm bed portion 2 adjacent to the needle plate 6. The cover 30 is formed with a fingerhold 30*a* in the top left portion and a cut-out portion 31 with an opening on a free end. The cut-out portion is substantially quarter circle shaped as viewed from the front.

A support 32 composed of a synthetic resin or the like has a base portion 32*b* at which the support 32 is fixed on a back surface of the cover 30 via a screw 36 as shown in FIGS. 8–11. An edge 32*a* of the support 32 has a substantially quarter arc shape of a circle, and an edge 32*c* forms substantially vertical line in a lower end below the base portion 32*b*. An edge of the cut-out portion 31 and the edge 32*a* of the support 32 form a guide groove 33 for guiding a bobbin thread 11.

Figure 10:
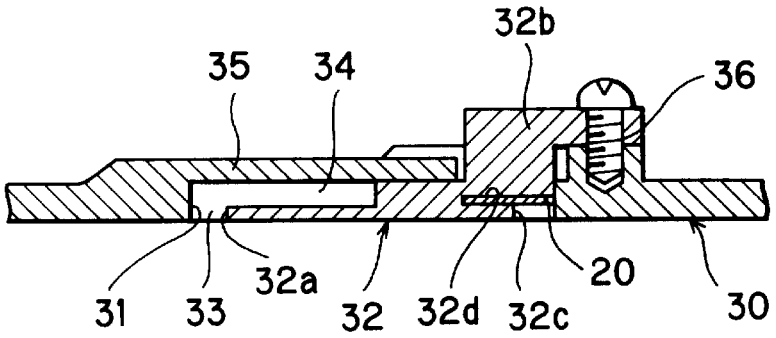
FIG. 10 is a cross-sectional view taken along the line X—X of FIG. 8.
Figure 11:
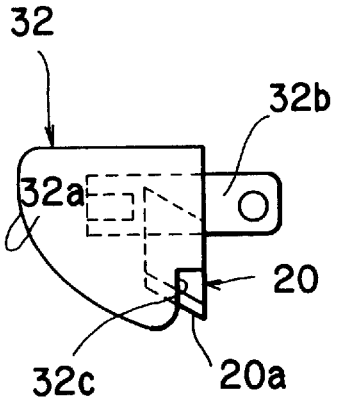
FIG. 11 is a view showing a cutting blade mounted in a support according to the second embodiment.

Further, the support 32 is formed with a mounting groove 32*d* as shown in FIG. 10. The cutting blade 20 is detachably mounted in the mounting groove 32*d* so that the blade edge 20*a* faces downward and is exposed to the guide groove 33. At this time, a line extending along the blade edge 20*a* intersects with a line extending along the side edge 32*c* forming an acute angle.

A support member 35 for supporting the bobbin thread 11 is integrally formed on the back side of the cover 30 or on the bed 2. The support member 35 extends to the back side of the support 32 so as to form a bobbin thread passage 34 between the support 32 and the support member 35, the passage 34 being in communication with the guide groove 33.

Figure 8:
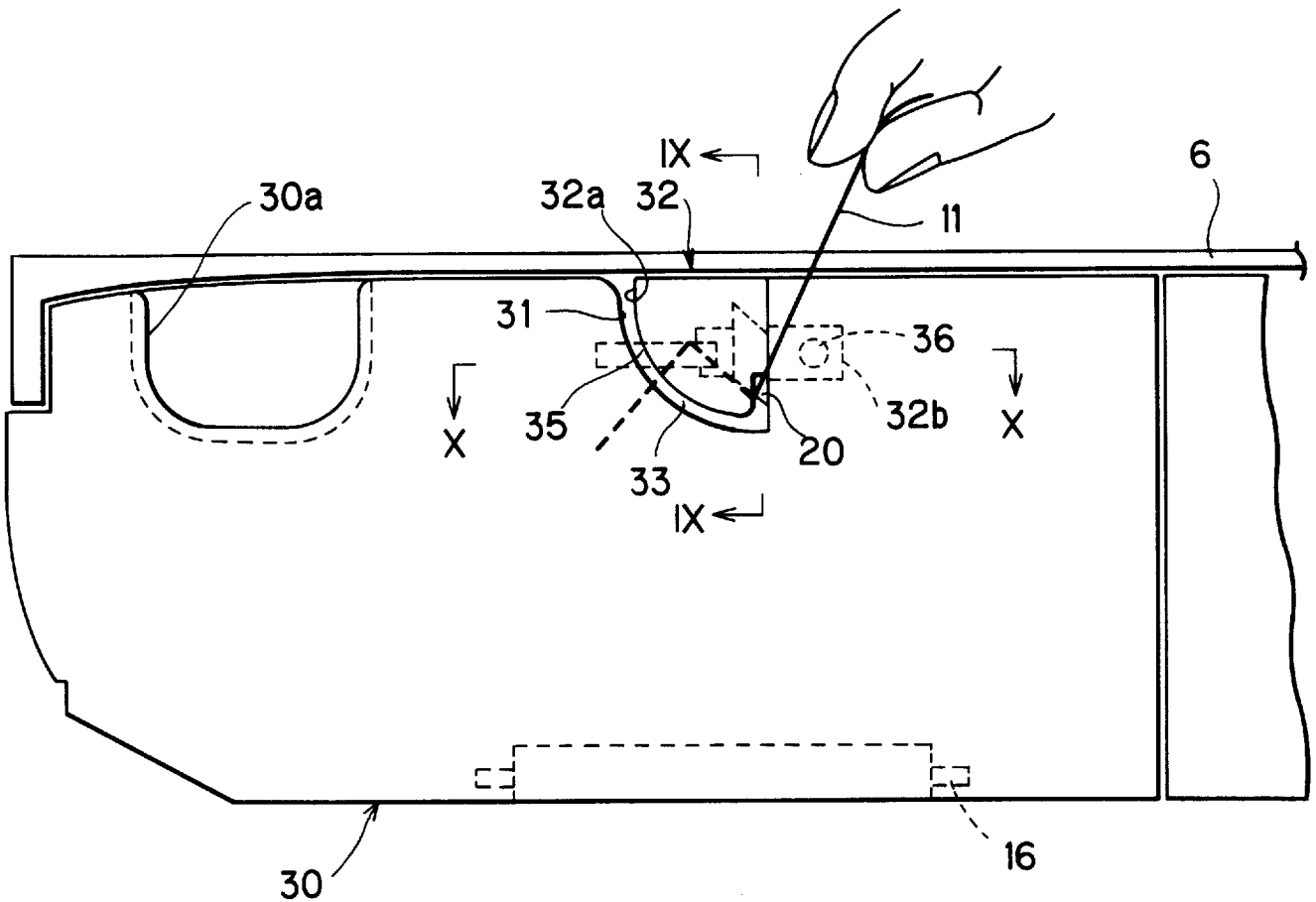
FIG. 8 is a view showing an essential portion according to a second embodiment of the present invention.
Figure 9:
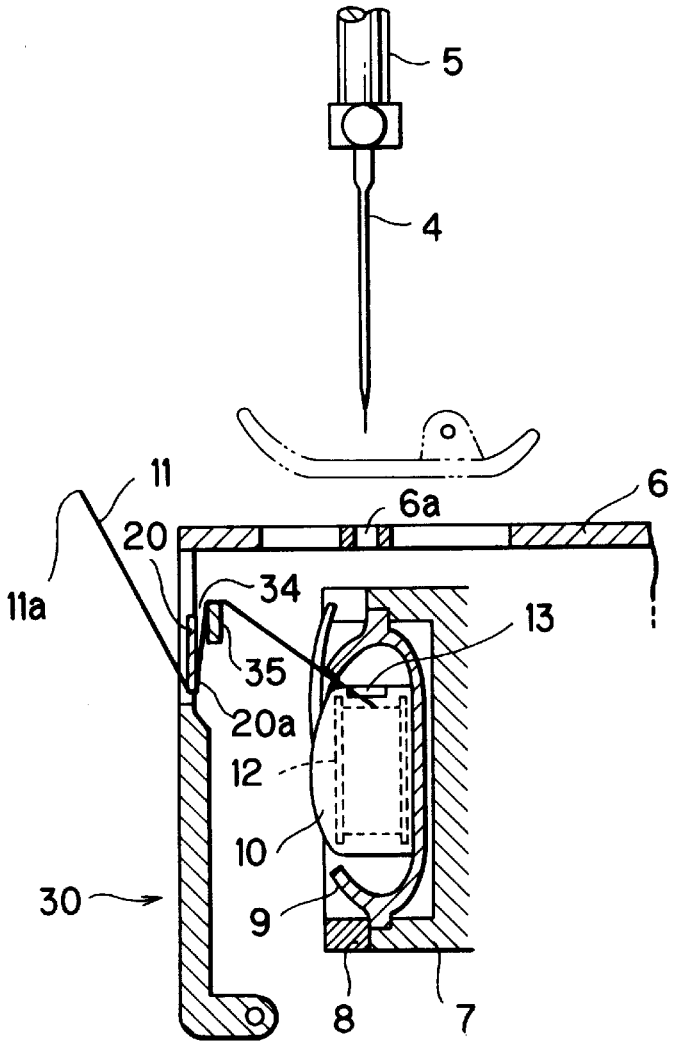
FIG. 9 is an cross-sectional view taken along the line IX—IX of FIG. 8.

Next, operation of the bobbin thread cutting device of the second embodiment will be described. First, the cover 30 is opened forward from the top and laid down flat. Then, the bobbin thread 11 extending from the tension generating portion 13 is guided out through the gap formed between the needle plate 6 and the cover 30. After the cover 30 is closed, the bobbin thread 11 is guided to the open end of the guide groove 33. When the bobbin thread 11 is pulled downward out of the cover 30, the midway portion of the bobbin thread 11 is bent around the top surface of the support member 35, and passes through both the bobbin thread passage 34 and the guide groove 33. Then, the bobbin thread 11 reaches the bottom portion of the guide groove 33. By being pulled upward, the bobbin thread 11 contacts the blade edge 20*a* of the cutting blade 20 as shown in FIGS. 8 and 9, and is cut such that the length of the bobbin thread 11 pulled out from the tension generating portion 13 is a predetermined amount.

As described above, the portion of the bobbin thread 11 extending from the support member 35 to the blade edge 20*a* is not parallel to the portion of bobbin thread 11 extending out of the cover 30 when the bobbin thread 11 is about to be cut. Further, the bobbin thread 11 is bent sharply around two parts, the support member 35 and the blade edge 20*a*, forming an acute angle at each of these parts. As a result, a resisting force is created at the points the bobbin thread 11 bends, allowing the bobbin thread 11 to be cut reliably with little tension. The end portion of the cut bobbin thread 11 can be temporarily anchored at the acute angled portion defined by the intersection of the blade edge 20*a* with the vertical edge 32*c*. Therefore, the cut end of the bobbin thread 11 does not become stuck in the area from the support member 35 to the bobbin thread passage 34 nor adhere to the shuttle body 9, thereby enabling the formation of a stitch at the beginning of sewing operation.

The support 32, in which the cutting blade 20 is mounted, is fixed to the cover 30 via the screw 36. This makes replacement of the small cutting blade 20 extremely easy.

In the first and second embodiments described above, the detachable bed portion 39 as shown in FIG. 13 to be removably mounted on the free arm bed portion 2 can cover the guide grooves 17, 33. With this configuration, scrap cloth and the like is prevented from entering the free arm bed portion 2 during sewing operations, such scrap cloth may become tangled in the stitch and produce irregular sewing work. Also, noise generated in the sewing machine is reliably prevented from coming out via the guide grooves 17, 33.

While the invention has been described in detail with reference to the specific embodiments thereof, it would be apparent to those skilled in the art that various changes and modifications may be made therein without departing from the spirit of the invention.

For example, a rotary hook can be used in place of the shuttle hook 9 as the loop taker. In this case, a length L3 is the minimum distance defined by the race surface formed on the rotary hook and the needle hole. Also, the cutting blade can be provided on the shuttle hook block 8, on a shuttle hook block fixing lever, or on the needle plate.

Further the line formed by the blade edge can intersect either one of right and left edges forming the guide groove at an acute angle. For example, in FIG. 5, acute angle is provided at the right edge of the groove 17 and the blade edge 20*a*. However, an acute angle can be provided at the left edge of the groove 17 and the blade edge 20*a* by changing an orientation of the blade edge.

Further, in the embodiments described above, the covers 15, 30 are arranged on the front surface of the sewing machine, that is, the side against which the user is positioned, thereby facilitating the process of inserting the bobbin thread into the guide groove. In this case, a rotational axis of the bobbin case extends in a direction perpendicular to the lengthwise direction of the sewing machine, that is, left to right as shown in FIG. 2. However, the cover can be positioned at a distal end portion of the free arm bed portion, that is, the left side of the free arm bed portion in FIG. 2. In this case, the rotational axis of the bobbin case extends in the lengthwise direction of the free arm bed portion.

Figure 12:
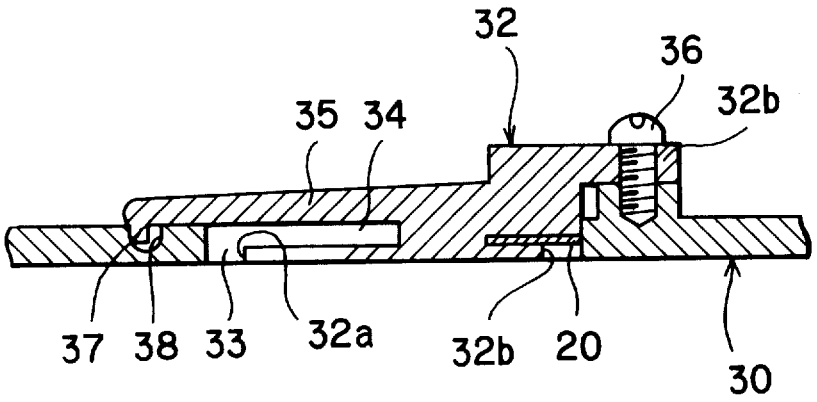
FIG. 12 is a cross-sectional view showing a support member integrally formed on the support according to a modification to the second embodiment.

Further, the support member 35 of the second embodiment can be integrally formed on the support 32, protruding across to the back surface of the cover 30 as shown in FIG. 12. In this case, a protrusion 37 is provided on the front surface at the end of the support member 35, and a depression 38 is formed in the back surface of the cover 30. The protrusion 37 is configured to fit tightly in the depression 38 in order that the midway portion of the bobbin thread 11 guided from the back surface of the cover 30 does not pass through the gap between the front surface of the support member 35 and the back surface of the cover 30 without passing over the top surface of the support member 35.

Figure 14:
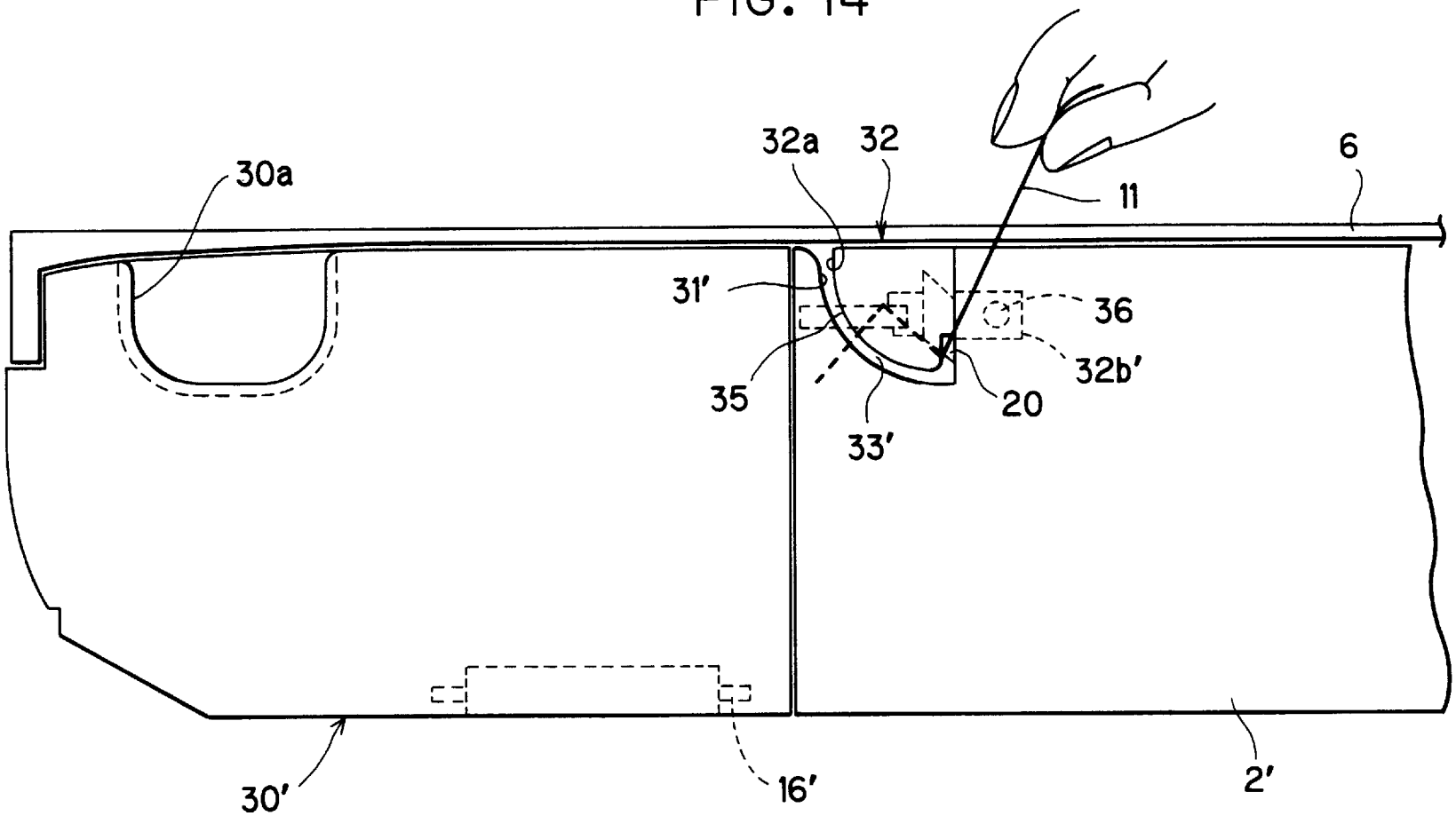
FIG. 14 is a view showing an essential portion of a sewing machine according to a modification to the second embodiment.

Further, in the first and second embodiments, the free arm bed portion 2 constitutes the bed when the detachable bed portion 39 is mounted thereon. Here, the free arm bed portion 2 can be referred to as a bed, even if the detachable bed portion 39 is not mounted. Further, instead of the combination of the free arm bed portion 2 and the detachable bed portion 39, a large bed can be provided as an integral component. In this case, the above described cutting arrangement can be provided to a front side wall or distal end wall of the bed, and at a position adjacent to the loop taker. Further, as shown in FIG. 14, the cutting blade 20 can be provided to a free arm bed portion 2' rather than to a cover 30'. In this case, a base portion 32*b'* is fixed on a back surface of the free arm bed portion 2' via a screw 36. Also, a guide groove 33' is defined between an edge of a cut-out portion 31' and an edge 32*a* of the support 32.

What is claimed is:

1. A sewing machine comprising:

a bed having an internal portion, a needle plate formed with a needle hole on the bed;

a needle retaining a needle thread and movable into and out of the needle hole;

a loop taker positioned within the bed;

a bobbin case removably mounted inside the loop taker, the bobbin case having a tension generation portion;

a bobbin holding a bobbin thread and removably mounted in the bobbin case, the bobbin thread extending out of the bobbin case through the tension generation portion, and the loop taker forming stitches in cooperation with the sewing needle using the bobbin thread and the needle thread, the bobbin thread having a leading end portion and a subsequent portion;

a cover attached to the bed near the loop taker and movable between an open position and a closed position, the cover extending in a vertical direction at the closed position; and a cutting blade having a blade edge for cutting the bobbin thread extending out of the bobbin case, the cutting blade being provided at one of the cover and the bed near the cover, wherein the leading end portion of the bobbin thread is pulled out of the bed and extends from the cutting blade edge in a first direction and the subsequent portion of the bobbin thread is pulled and extends from the tension generation portion linearly without bending to the blade edge in a second direction when the bobbin thread is about to be cut, the blade edge providing a geometrical relationship with respect to the tension generation portion to intersect the first direction with the second direction.

2. The sewing machine as claimed in claim 1, wherein one of the cover and the bed is formed with a guide groove having opposing side edges and an open end in communication with the internal portion when the cover is moved to its open position;

and wherein the cutting blade is provided in the guide groove, the blade edge of the cutting blade forming an acute angle with respect to one of the opposing side edges to provide an acute angled portion where a cut end of the bobbin thread is temporarily anchored.

3. The sewing machine as claimed in claim 2, wherein a bobbin thread passage is defined from the tension generation portion to the blade edge, and the leading end portion and the subsequent portion of the bobbin thread pass along the bobbin thread passage when the bobbin thread is to be cut, the bobbin thread passage having a length capable of performing an initial stitching.

4. The sewing machine as claimed in claim 3, wherein the bobbin thread passage defines a first distance, and the tension generation portion and the needle hole define a second distance therebetween, and a race surface that supports the loop take in a stitch forming operation and the needle hole define a third distance therebetween, the first distance being greater than the second distance and a sum of the second distance and the third distance being grater than the first distance.

5. The sewing machine as claimed in claim 2, wherein the bed comprises a free arm bed portion formed with the guide groove, and a detachable bed portion mountable on the free arm bed portion, the detachable bed portion covering the guide groove when the detachable bed portion is mounted on the free arm bed portion.

6. The sewing machine as claimed in claim 1, wherein the bobbin has a rotational axis, and wherein the cover is pivotally movably supported to the bed and orthogonal to the rotational axis at the closed position.

7. The sewing machine as claimed in claim 1, wherein the cover is moved to the open position and the closed position when the bobbin case is about to be mounted inside and dismounted out of the loop taker.

8. The sewing machine as claimed in claim 1, wherein the cover has an outer surface and an inner surface, the outer surface facing a user when the cover is at the closed position.

9. The sewing machine as claimed in claim 1, wherein the support member has a geometrical relationship with the blade edge to provide an acute angle of the bobbin thread at the blade edge when the bobbin thread is pulled out of the bed, and wherein the bobbin thread extending out of the tension generation portion is cut at the blade edge by being pulled out of the bed.

10. A sewing machine comprising:

a bed having an internal portion;

a needle plate formed with a needle hole on the bed;

a needle retaining a needle thread and movable into and out of the needle hole;

a loop taker positioned within the bed;

a bobbin case removably mounted inside the loop taker, the bobbin case having a tension generation portion;

a bobbin holding a bobbin thread and removably mounted in the bobbin case, the bobbin thread extending out of the bobbin case through the tension generation portion, and the loop taker forming stitches in cooperation with the sewing needle using the bobbin thread and the needle thread;

a cover attached to the bed near the loop taker and movable between an open position and a closed position, the cover extending in a vertical direction at the closed position;

a cutting blade having a blade edge for cutting the bobbin thread extending out of the bobbin case, the cutting blade being provided at one of the cover and the bed near the cover, a bobbin thread passage being defined between the tension generation portion and the blade edge; and a support member provided to one of the cover and the bed for supporting the bobbin thread between the tension generation portion and the blade edge, the support member being positioned between the tension generation portion and the blade edge and having the bobbin thread passage to be bent;

wherein the cutting blade and the support member do not move relative to each other during cutting of the bobbin thread.

11. The sewing machine as claimed in claim 10, wherein the support member has a geometrical relationship with the blade edge to provide an acute angle of the bobbin thread at the blade edge when the bobbin thread is pulled out of the bed.

12. The sewing machine as claimed in claim 10, wherein the support member is provided detachably from one of the cover and the bed, the cutting blade being mounted on the support member.

13. The sewing machine as claimed in claim 10, wherein one of the cover and the bed is formed with a guide groove having opposing side edges and an open end in communication with the internal portion when the cover is moved to its open position;

and wherein the cutting blade is provided in the guide groove, the blade edge forming an acute angle with respect to one of the opposing side edges to provide an acute angled portion where a cut end of the bobbin thread is temporarily anchored.

14. The sewing machine as claimed in claim 13, wherein the bobbin thread has a leading end portion and a subsequent portion, the leading end portion and the subsequent portion of the bobbin thread passing along the bobbin thread passage when the bobbin thread is to be cut, the bobbin thread passage having a path length capable of performing an initial stitching.

15. The sewing machine as claimed in claim 13, wherein the bed comprises a free arm bed portion formed with the guide groove, and a detachable bed portion mountable on the free arm bed portion, the detachable bed portion covering the guide groove when the detachable bed portion is mounted on the free arm bed portion.

16. The sewing machine as claimed in claim 10, wherein the bobbin has a rotation axis, and wherein the cover is pivotally movably supported to the bed and orthogonal to the rotation axis at the closed position.

17. The sewing machine as claimed in claim 10, wherein the cover is moved to the open position and the closed position when the bobbin case is about to be mounted inside and dismounted out of the loop taker.

18. The sewing machine as claimed in claim 10, wherein the cover has an outer surface and an inner surface, the outer surface facing a user when the cover is at the closed position.

19. The sewing machine as claimed in claim 10, wherein the support member has a geometrical relationship with the blade edge to provide an acute angle of the bobbin thread at the blade edge when the bobbin thread is pulled out of the bed, and wherein the bobbin thread extending out of the tension generation portion is cut at the blade edge by being pulled out of the bed.

20. A bobbin thread cutting device to be used in combination with a sewing machine, the sewing machine comprising a bed having an internal portion, a needle plate formed with a needle hole on the bed, a needle retaining a needle thread and movable into and out of the needle hole, a loop taker positioned within the bed, a bobbin case removably mounted inside the loop taker, the bobbin case having a tension generation portion, a bobbin holding a bobbin thread and removably mounted in the bobbin case, the bobbin thread extending out of the bobbin case through the tension generation portion, and the loop taker forming stitches in cooperation with the sewing needle using the bobbin thread and the needle thread, the bobbin thread having a leading end portion and a subsequent portion, and a cover attached to the bed near the loop taker and movable between an open position and a closed position, the cover extending in a vertical direction at the closed position, the cutting device comprising:

a cutting blade having a blade edge for cutting the bobbin thread extending out of the bobbin case, the cutting blade being provided at one of the cover and the bed near the cover, wherein the leading end portion of the bobbin thread is pulled out of the bed and extends from the cutting blade in a first direction and the subsequent portion of the bobbin thread is pulled and extends from the tension generation portion linearly without bending to the blade edge in a second direction when the bobbin thread is about to be cut, the blade edge providing a geometrical relationship with respect to the tension generation portion to intersect the first direction with the second direction.

21. The bobbin thread cutting device as claimed in claim 20, wherein one of the cover and the bed is formed with a guide groove having opposing side edges and an open end in communication with the internal portion when the cover is moved to its open position;

and wherein the cutting blade is provided in the guide groove, the blade edge of the cutting blade forming an acute angle with respect to one of the opposing side edges to provide an acute angled portion where a cut end of the bobbin thread is temporarily anchored.

22. The bobbin thread cutting device as claimed in claim 21, wherein a bobbin thread passage is defined from the tension generation portion to the blade edge, and the leading end portion and the subsequent portion of the bobbin thread pass along the bobbin thread passage when the bobbin thread is to be cut, the bobbin thread passage having a length capable of performing an initial stitching.

23. The bobbin thread cutting device as claimed in claim 20, wherein the cover has an outer surface and an inner surface, the outer surface facing a user when the cover is at the closed position.

24. The bobbin thread cutting device as claimed in claim 20, wherein the cover is pivotally supported on the bed.

25. The bobbin thread cutting device as claimed in claim 20, wherein the support member has a geometrical relationship with the blade edge to provide an acute angle of the bobbin thread at the blade edge when the bobbin thread is pulled out of the bed, and wherein the bobbin thread extending out of tension generation portion is cut at the blade edge after being pulled out of the bed.

26. A bobbin thread cutting device to be used in combination with a sewing machine, the sewing machine comprising a bed having an internal portion, a needle plate formed with a needle hole on the bed, a needle retaining a needle thread and movable into and out of the needle hole, a loop taker positioned within the bed, a bobbin case removably mounted inside the loop taker, the bobbin case having a tension generation portion, a bobbin holding a bobbin thread and removably mounted in the bobbin case, the bobbin thread extending out of the bobbin case through the tension generation portion, and the loop taker forming stitches in cooperation with the sewing needle using the bobbin thread and the needle thread, a cover attached to the bed near the loop taker and movable between an open position and a closed position, the cover extending in a vertical direction at the closed position, the cutting device comprising:

a cutting blade having a blade edge for cutting the bobbin thread extending out of the bobbin case, the cutting blade being provided at one of the cover and the bed near the cover a bobbin thread passage being defined between the tension generation portion and the blade edge; and a support member provided to one of the cover and the bed for supporting the bobbin thread between the tension generation portion and the blade edge, the support member being positioned between the tension generation portion and the blade edge and having the bobbin thread passage to be bent;

wherein the cutting blade and the support member do not move relative to each other during cutting of the bobbin thread.

27. The bobbin thread as claimed in claim 26, wherein the support member has a geometrical relationship with the blade edge to provide an acute angle of the bobbin thread at the blade edge when the bobbin thread is pulled out of the bed.

28. The sewing machine as claimed in claim 26, wherein the support member is provided detachably from one of the cover and the bed, the cutting blade being mounted on the support member.

29. The bobbin thread cutting device as claimed in claim 26, wherein the cover has an outer surface and an inner surface, and the outer surface faces a user when the cover is at the closed position.

30. The bobbin thread cutting device as claimed in claim 26, wherein the cover is pivotally supported on the bed.

31. The bobbin thread cutting device as claimed in claim 26, wherein the support member has a geometrical relationship with the blade edge to provide an acute angle of the bobbin thread at the blade edge when the bobbin thread is pulled out of the bed, and wherein the bobbin thread extending out of tension generation portion is cut at the blade edge after being pulled out of the bed.

* * * * *